US007232209B2

(12) United States Patent
Asauchi

(10) Patent No.: US 7,232,209 B2
(45) Date of Patent: Jun. 19, 2007

(54) NON-CONTACT COMMUNICATION BETWEEN A DEVICE AND ITS EXPENDABLE CONTAINER

(75) Inventor: Noboru Asauchi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 292 days.

(21) Appl. No.: 10/816,167

(22) Filed: Apr. 2, 2004

(65) Prior Publication Data

US 2005/0001718 A1 Jan. 6, 2005

(30) Foreign Application Priority Data

Apr. 10, 2003 (JP) ..... 2003-106603

(51) Int. Cl.
*B41J 2/175* (2006.01)
*G08B 13/14* (2006.01)
*G03G 15/00* (2006.01)

(52) U.S. Cl. ..... 347/86; 347/19; 340/572.1; 340/572.7; 340/539.3; 399/12

(58) Field of Classification Search ..... 347/19; 340/539.3
See application file for complete search history.

(56) References Cited

U.S. PATENT DOCUMENTS 5,914,671 A * 6/1999 Tuttle ..... 340/10.42
6,208,235 B1 * 3/2001 Trontelj ..... 340/10.1
6,356,197 B1 * 3/2002 Patterson et al. ..... 340/572.1
6,549,119 B1 * 4/2003 Turner ..... 340/10.5
6,585,345 B2 * 7/2003 Kosugi ..... 347/19
6,676,240 B2 * 1/2004 Walker ..... 347/19
2002/0175806 A1 * 11/2002 Marneweck et al. ..... 340/10.33

FOREIGN PATENT DOCUMENTS

| | | | |
|---|---|---|---|
| JP | 08-036623 | A | 2/1996 |
| JP | 08-086863 | A | 4/1996 |
| JP | 08-094746 | A | 4/1996 |
| JP | 11-306297 | A | 11/1999 |
| JP | 2001-191511 | A | 7/2001 |
| JP | 2002-005724 | A | 1/2002 |
| JP | 2002-063097 | A | 2/2002 |

* cited by examiner

*Primary Examiner*—Matthew Luu
*Assistant Examiner*—Shelby Fidler
(74) *Attorney, Agent, or Firm*—Sughrue Mion, PLLC

(57) ABSTRACT

An expendable container of the present invention includes a memory circuit. The memory circuit has a memory, an antenna being capable of establishing non-contact communication with an external receiver transmitter, and a controller controlling the non-contact communication and an access to the memory. The memory circuit has a plurality of modes including ID information confirmation mode and low power consumption mode. The memory circuit is capable of shifting to the low power consumption mode in response to a completion of confirmation of the ID information of the expendable container.

7 Claims, 10 Drawing Sheets

NON-CONTACT COMMUNICATION BETWEEN A DEVICE AND ITS EXPENDABLE CONTAINER

BACKGROUND OF THE INVENTION

1. Field of the Invention

The present invention relates to a technique of non-contact communication between a device like a printing device and its expendable container.

2. Description of the Related Art

The application of non-contact tags to a data carrier has been proposed recently. Such a non-contact tag may be attached to, for example, an ink cartridge for inkjet printers. Some pieces of useful information, for example, the expiration date of ink, are stored in the non-contact tag. The printer main body acquires these pieces of information from an ink cartridge attached to the printer main body through electromagnetic-inducing communication. The electromagnetic-inducing communication may adopt the anti-collision function that allows for communication with multiple non-contact tags without collisions (interference).

The anti-collision function causes each command sent from the printer main body to include corresponding one among respective ID informations separately held by the multiple non-contact tags. Only a non-contact tag with the corresponding ID information responds to the command. The anti-collision function is on the premise that the printer main body has the respective ID informations on the multiple non-contact tags. The mapping of the ID information to the attachment position of each ink cartridge is also required for adequate user of the ink cartridge in the printer.

One proposed technique of the electromagnetic-inducing communication regulates the relative position of a non-contact tag attached to each ink cartridge to an antenna of the printer and the transmission output of the antenna, which cause sufficient electromagnetic induction only in a target non-contact tag, so as to acquire ID information of the ink cartridge with the target non-contact tag at each attachment position.

There is, however, a manufacturing variation in resonance frequency among multiple different resonance circuits included in non-contact tags. It is accordingly possible that a non-contact tag having a resonance frequency extremely close to the frequency of the transmission output of the antenna is located adjacent to a non-contact tag having a resonance frequency relatively apart from the frequency of the transmission output of the antenna.

In such cases, excess induced current flows in the antenna of the former non-contact tag and undesirably weakens the surrounding AC magnetic field. This may cause a potential problem that only an insufficient induced voltage is generated in the antenna of the non-contact tag adjoining to the former non-contact tag.

The enhanced transmission output of the antenna in the printer, on the other hand, causes another problem that the antenna of the printer may establish an unexpected communication with another non-contact tag that is not adjacent to the former non-contact tag. These problems are not restricted to the ink cartridges but are commonly found in any expendable containers that utilize non-contact tags for storage of information on expendables.

SUMMARY OF THE INVENTION

The object of the invention is thus to eliminate the drawbacks of the prior art and to provide a technique that reduces a drop of induced voltage in a non-contact tag.

There is provided an expendable container storing an expendable. The expendable container comprises a memory circuit. The memory circuit has a memory, an antenna being capable of establishing non-contact communication with an external receiver transmitter, and a controller controlling the non-contact communication and an access to the memory. The memory circuit has a plurality of modes including ID information confirmation mode and low power consumption mode. The ID information confirmation mode is for the external receiver transmitter to communicate with the memory circuit in order to confirm ID information of the expendable container. The low power consumption mode is for the controller to lessen function. The memory circuit is capable of shifting to the low power consumption mode in response to a completion of confirmation of the ID information of the expendable container.

The expendable container of the invention shifts to the low power consumption mode, in which the controller stops its function, in response to a completion of confirmation of ID information on the expendable container. This arrangement effectively reduces a drop of induced voltage in a non-contact tag attached to an adjoining expendable container.

The technique of the invention is implemented by diversity of applications, for example, a device with an expendable container detachably attached thereto, an expendable container, a storage element or a memory circuit for an expendable container, a printing device (printer), a computer system including a device with an expendable container detachably attached thereto, methods of controlling the operations of such device, system, and storage element, computer programs to attain the functions of such device, system, and storage element, recording media with such computer programs recorded therein, and data signals that include such computer programs and are embodied in carrier waves.

BRIEF DESCRIPTION OF THE DRAWINGS

FIG. 3(*b*) shows the relative positions of non-contact tags to an antenna.

FIG. 4(*b*) shows the structure of the non-contact tag 311 and the receiver transmitter 30.

FIG. 5(*b*) shows the details of information stored in the memory 3117.

FIG. 8(*b*) shows an operation sequence of the carriage 20 when the color printer 10 activates the receiver transmitter 30 to confirm the ID information stored in each of the non-contact tags 311 through 316.

FIG. 8(*c*) shows an operation sequence of the carriage 20 when the color printer 10 activates the receiver transmitter 30 to confirm the ID information stored in each of the non-contact tags 311 through 316.

FIG. 8(*d*) shows an operation sequence of the carriage 20 when the color printer 10 activates the receiver transmitter 30 to confirm the ID information stored in each of the non-contact tags 311 through 316.

FIG. 8(*e*) shows an operation sequence of the carriage 20 when the color printer 10 activates the receiver transmitter 30 to confirm the ID information stored in each of the non-contact tags 311 through 316.

DESCRIPTION OF THE PREFERRED EMBODIMENTS

One mode of carrying out the invention is discussed below in the following sequence:

A. Structure of Color Printer

B. Communication between Color Printer and Non-Contact Tag

C. Modifications

A. Structure of Color Printer

Figure 1:
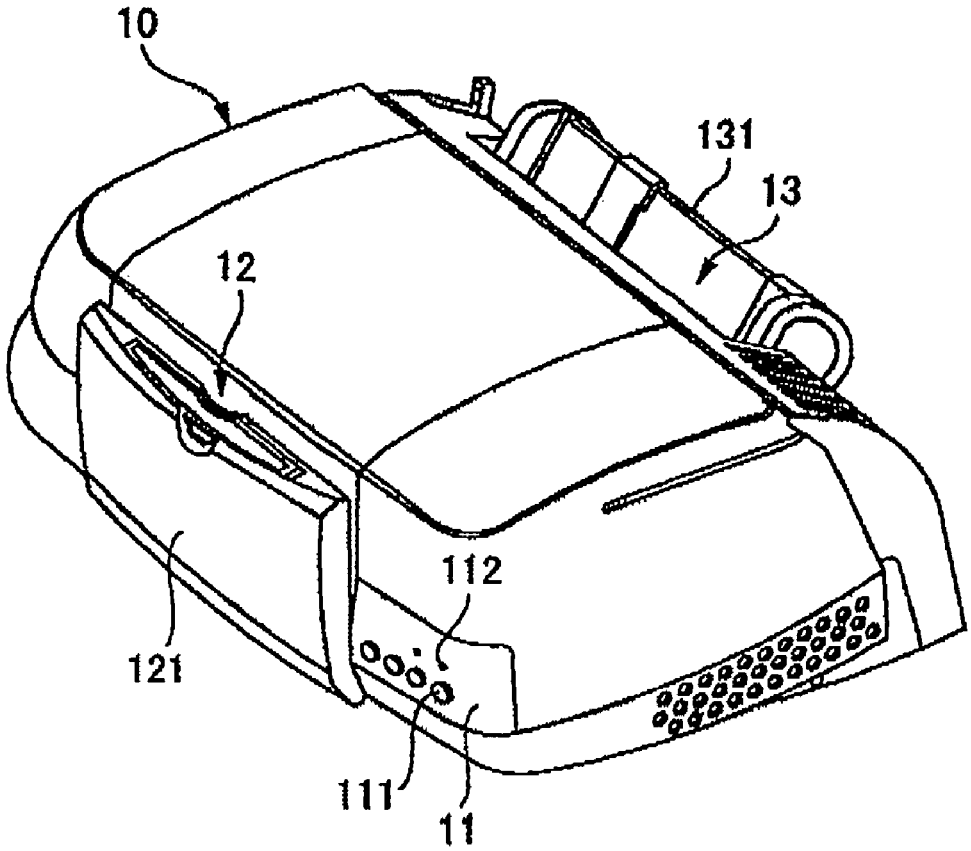
FIG. 1 is a perspective view schematically showing the appearance of a color printer 10 in one embodiment of the invention.

FIG. 1 is a perspective view schematically showing the appearance of a color printer 10 in one embodiment of the invention. The color printer 10 is an inkjet printer that forms an image on a printing medium by ejection of four color inks, cyan (C), magenta (M), yellow (Y), and black (K), as well as two light colored inks, light cyan having a lower density than cyan ink and light magenta having a lower density than magenta ink.

Figure 2:
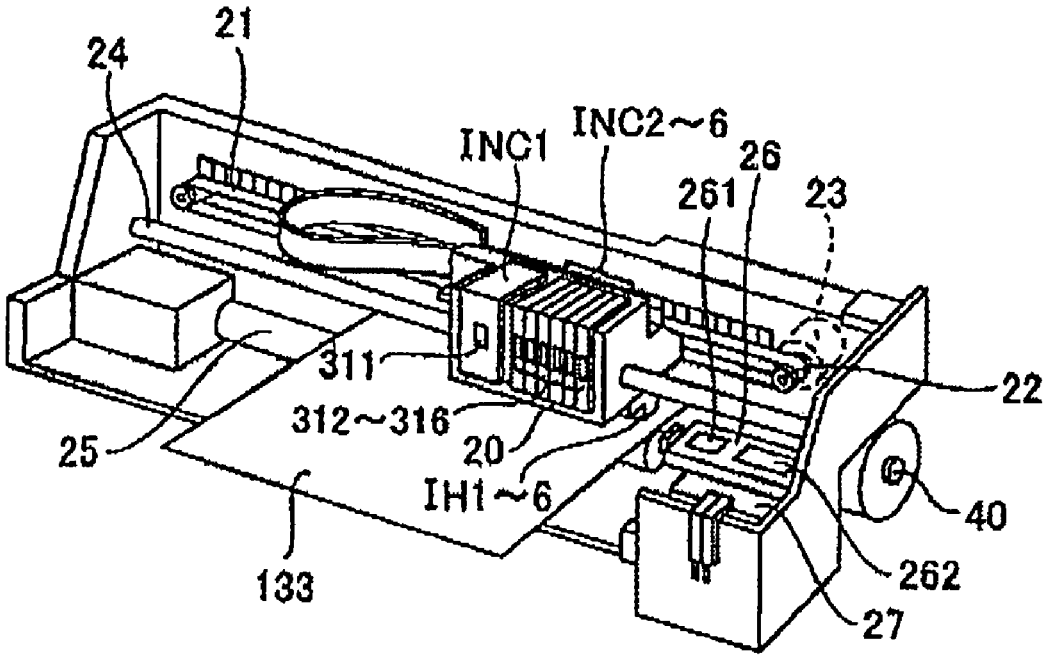
FIG. 2 is a perspective view showing the internal structure of the color printer 10.

FIG. 2 is a perspective view showing the internal structure of the color printer 10. One black ink unit INC1 for keeping black ink therein and five color ink units INC2 through INC6 for respectively keeping five color inks therein are attached to a carriage 20. The carriage 20 is designed to move parallel to a platen 25 by means of a carriage motor 23 and a drive belt 21. The carriage motor 23 has a non-illustrated encoder and sets the carriage 20 at an arbitrary position by feedback control.

Figure 3A:
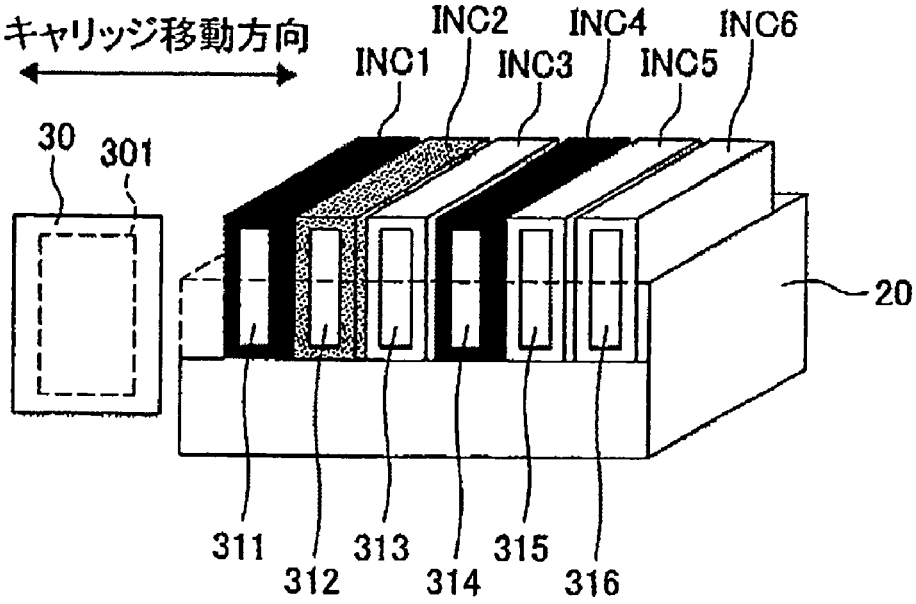
FIG. 3(*a*) shows the relative positions of non-contact tags to an antenna.
Figure 3B:
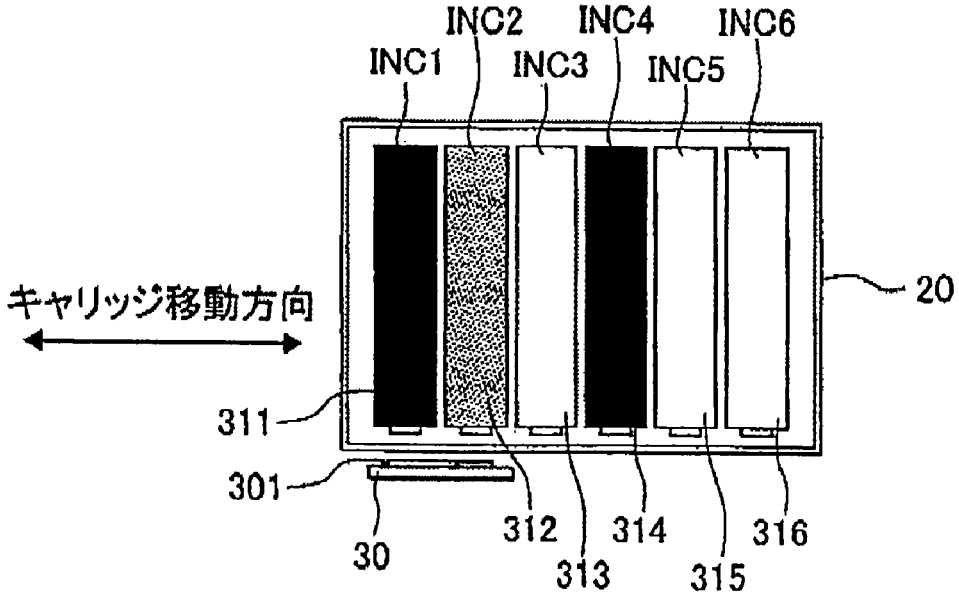

FIGS. 3(*a*) and 3(*b*) show the relative positions of six non-contact tags 311 through 316 attached to the respective ink units INC1 through INC6 to an antenna 301 included in a receiver transmitter 30 of the printer 10. As clearly understood of FIG. 3(*b*), the antenna 301 has a width to simultaneously face two of the non-contact tags 311 through 316. The output of the receiver transmitter 30 is regulated to cause electromagnetic induction transmittable with only the two facing non-contact tags. In the illustrated example of FIG. 3(*b*), the output of the antenna 301 is regulated to be transmittable with only the non-contact tags 311 and 312.

Figure 4A:
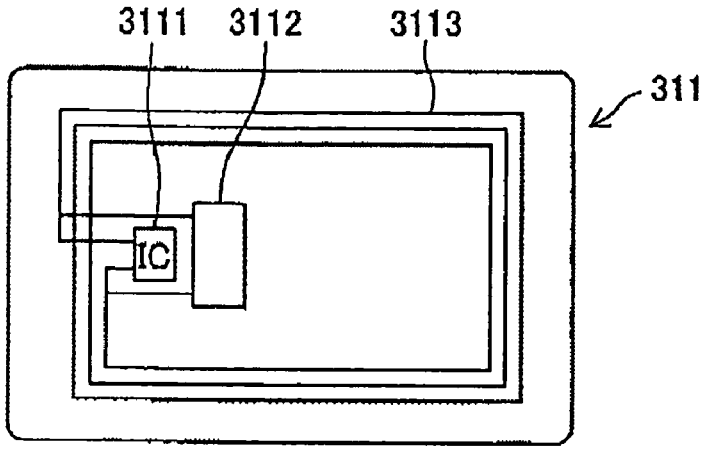
FIG. 4(*a*) shows the structure of the non-contact tag 311 and the receiver transmitter 30.
Figure 4B:
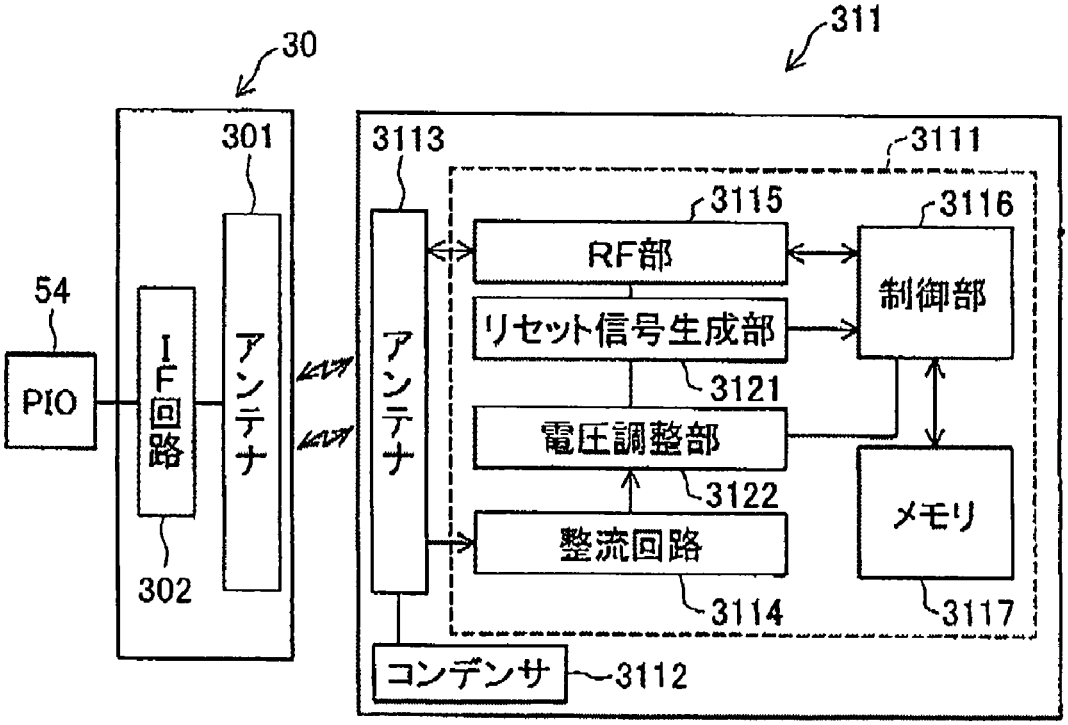

FIGS. 4(*a*) and 4(*b*) show the structure of the non-contact tag 311 and the receiver transmitter 30. FIG. 4(*a*) is a plan view showing the structure of the non-contact tag 311. The non-contact tag 311 used in this embodiment is a proximity-type (coverage of 2 mm to 10 cm) non-contact tag in conformity with ISO/IEC14443. The non-contact tag 311 includes an IC chip 3111, a resonant capacitor 3112 formed by etching a metal film, and an antenna 3113 as a plane coil, which are all mounted on a plastic film.

FIG. 4(*b*) is a block diagram showing the internal structure of the non-contact tag 311 and the receiver transmitter 30. The IC chip 3111 of the non-contact tag 311 includes a rectifier circuit 3114, a voltage regulator 3122, a reset signal generator 3121, an RF (radio frequency) unit 3115, a controller 3116, and a non-volatile memory 3117. The receiver transmitter 30 includes the antenna 301 and an IF circuit 302, which is linked to a peripheral equipment input-output unit (PIO) 54 included in a printer control circuit (discussed later).

The rectifier circuit 3114 carries out full-wave rectification to convert AC power, which is excited in the antenna 3113 by an AC magnetic field generated by the receiver transmitter 30, into DC power. The voltage regulator 3122 stabilizes the DC power generated by the rectifier circuit 3114 and supplies the stabilized DC power to the reset signal generator 3121, the RF unit 3115, and the controller 3116. The reset signal generator 3121 outputs a reset signal to the controller 3116, in response to the output voltage of the voltage regulator 3122. The control circuit 3116 controls 'stop' and 'operation' in response to the input reset signal. The controller 3116 functions to control the RF unit 3115 and read and write data from and into the memory 3117.

The RF unit 3115 has the functions of:

(1) extracting a reference clock signal from the AC power excited in the antenna 3113 to utilize the extracted reference clock signal as the own operation reference, while supplying the extracted reference clock signal to the controller 3116; and (2) demodulating signals received from the receiver transmitter 30 and modulating signals to be transmitted to the receiver transmitter 30.

Figure 5A:
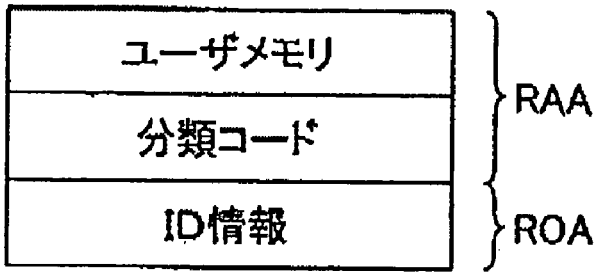
FIG. 5(*a*) shows the details of information stored in the memory 3117.
Figure 5B:
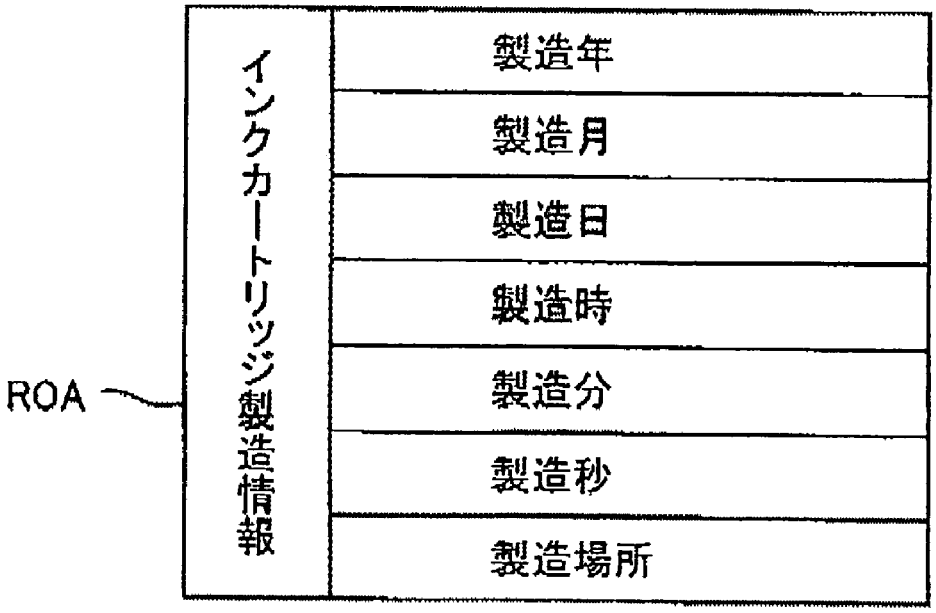

FIGS. 5(*a*) and 5(*b*) show the details of information stored in the memory 3117. The memory 3117 has a rewritable area RAA that allows the color printer 10 to read data therefrom and write data therein and a non-rewritable area ROA that allows the color printer 10 to read data therefrom but not to write data therein (FIG. 5(*a*)).

The rewritable area RAA is further divided into a user memory and a classification code storage area. The user memory is used for writing, for example, information on remaining quantity of ink in the ink unit INC1. The color printer 10 may read the ink remaining quantity information from this user memory and give an alarm to the user when the remaining quantity becomes to or below a preset level. The classification code storage area stores various codes for identifying the types of the ink units. The user may personally use these codes.

The non-rewritable area ROA stores manufacturing information on the ink unit INC1 with the non-contact tag 311 attached thereto. The manufacturing information includes unique ID information for identification of the ink unit INC1 and information on the year, month, day, hour, minute, and second when and the place where the ink unit INC1 was manufactured (FIG. 5(*b*)).

Figure 6:
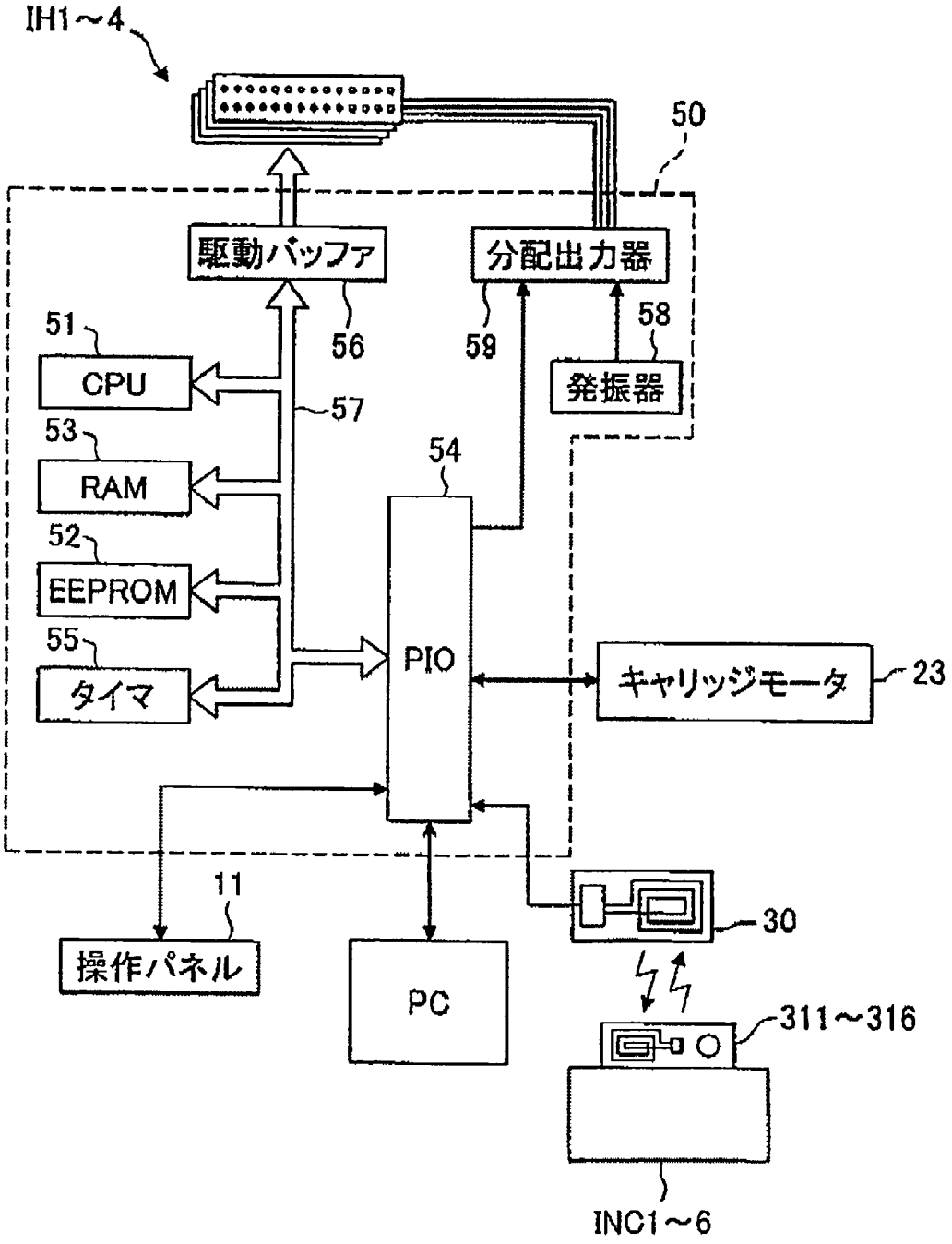
FIG. 6 is a block diagram showing the internal structure of control circuit 50 of the color printer 10.

FIG. 6 is a block diagram showing the internal structure of control circuit 50 of the color printer 10. The control circuit 50 includes a CPU 51, an EEPROM 52, a RAM 53, a peripheral equipment input-output unit (PIO) 54, a timer 55, a drive buffer 56, an oscillator 58, and an output distributor 59.

The PIO 54 is connected with an operation panel 11, a personal computer PC, the carriage motor 23, and the receiver transmitter 30. The drive buffer 56 functions to supply on-off signals for dot formation to print heads IH1 through IH6. Driving waveforms from the oscillator 58 are supplied via the output distributor 59 to the respective print heads IH1 through IH6.

B. Communication Between Color Printer and Non-Contact Tag

Figure 7:
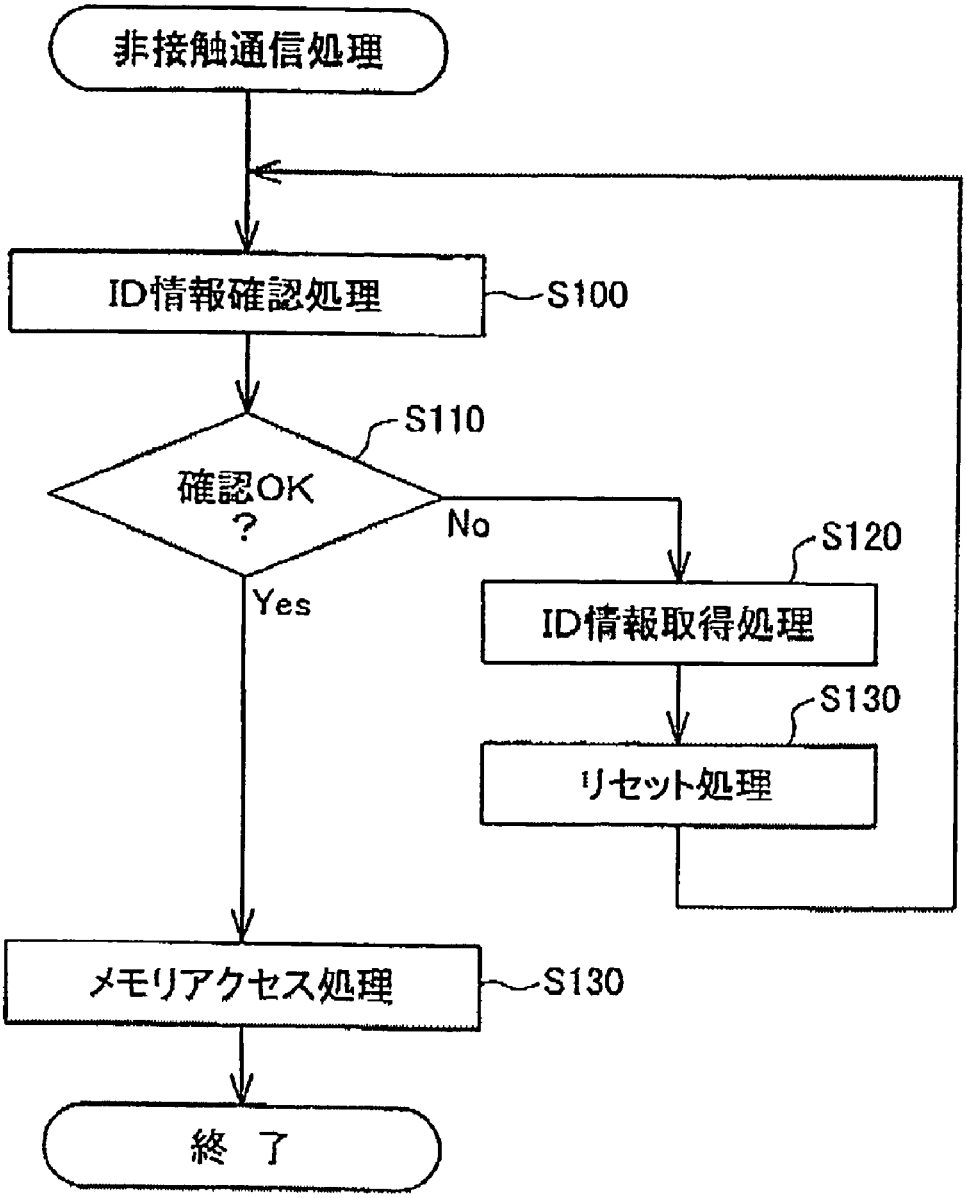
FIG. 7 is a flowchart showing a process of communication between each of the non-contact tags 311 through 316 attached to the respective ink units INC1 through INC6 and the receiver transmitter 30 of the color printer 10.
Figure 8A:
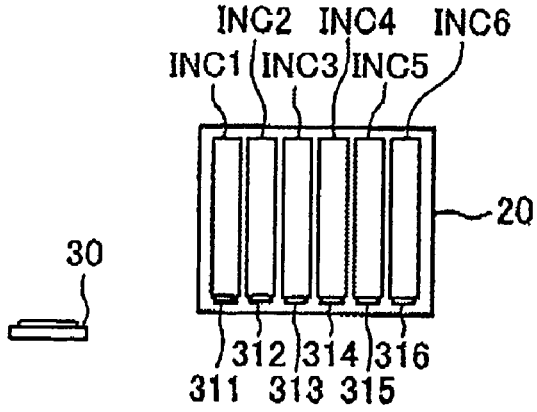
FIG. 8(*a*) shows an operation sequence of the carriage 20 when the color printer 10 activates the receiver transmitter 30 to confirm the ID information stored in each of the non-contact tags 311 through 316.
Figure 8B:
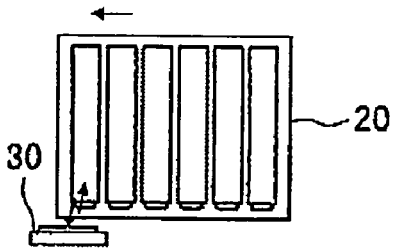
Figure 8C:
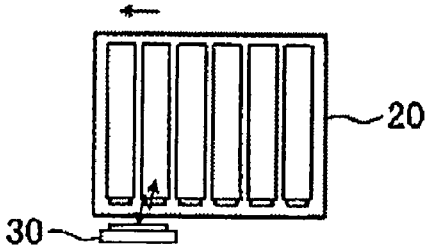
Figure 8D:
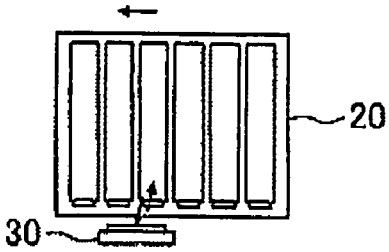
Figure 8E:
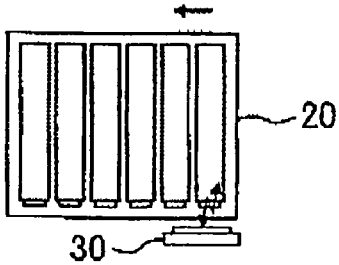

FIG. 7 is a flowchart showing a process of communication between each of the non-contact tags 311 through 316 attached to the respective ink units INC1 through INC6 and the receiver transmitter 30 of the color printer 10.

At step S100, the color printer 10 carries out an ID information confirmation process, which confirms whether ID information held in the color printer 10 is identical with ID information stored in each of the non-contact tags 311 through 316. The ID information confirmation process is executed, for example, at each power-on time and in response to the user's replacement of any of the ink units INC1 through INC6 in the power-on state.

Figure 9:
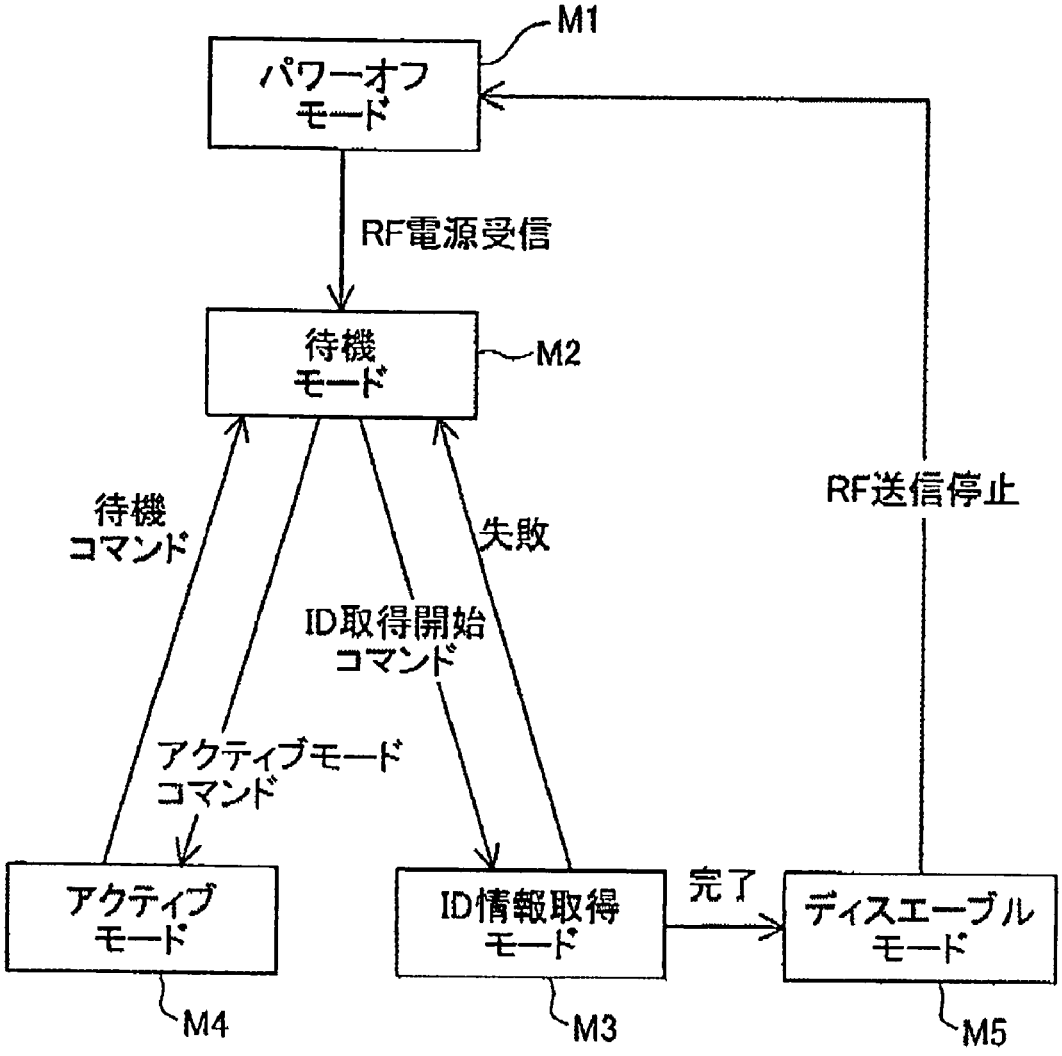
FIG. 9 is a state transition chart showing operation modes of the non-contact tag 311.

FIGS. 8(*a*) through 8(*e*) shows an operation sequence of the carriage 20 when the color printer 10 activates the receiver transmitter 30 to confirm the ID information stored in each of the non-contact tags 311 through 316. FIG. 9 is a state transition chart showing operation modes of the non-contact tag 311. The non-contact tag 311 has five modes, that is, a power-off mode Ml, a standby mode M2, an ID information acquisition mode M3, an active mode M4, and a disable mode M5. The other non-contact tags 312 through 316 also have these modes.

In the non-access state of FIG. 8(*a*), the receiver transmitter 30 does not establish communication with any of the non-contact tags 311 through 316. In this state, the carriage 20 is located apart to the right from a left non-printing area with the receiver transmitter 30, and all the non-contact tags 311 through 316 are accordingly set in the power-off mode M1. The controller 3116 and the RF unit 3115 stop their functions in the power-off mode M1.

In the state of FIG. 8(*b*), the carriage 20 stops at the position where the receiver transmitter 30 is communicable with only the non-contact tag 311. At this position, the right end of the antenna 301 of the receiver transmitter 30 faces the approximate center of the non-contact tag 311. The output of the receiver transmitter 30 is regulated to fail communication with the non-contact tag 312 for the ink unit INC2 at this position. In this state, only the non-contact tag 311 shifts to the standby mode M2, while the other non-contact tags 312 through 316 are kept in the power-off mode M1.

In the standby mode M2, the controller 3116 and the RF unit 3115 are in the power-off state. More specifically, the reset signal generator 3121 of the non-contact tag 312 (FIG. 4(*b*)) outputs a power-on reset command to the controller 3116, which accordingly starts its operation. The power-on reset command is output when the non-contact tag 311 approaches to the antenna 301 and the output voltage of the voltage regulator 3122 becomes sufficiently high for the operation of the non-contact tag 311.

At this position, the ID information of the non-contact tag 311 is confirmed. The confirmation of the ID information is performed according to the following procedure:

(1) The receiver transmitter 30 sends an active mode command including ID information read from the EEPROM 52;

(2) The non-contact tag 311 shifts to the active mode M4 when the ID information included in the active mode command is identical with the own ID information in the non-contact tag 311;

(3) On completion of the shift to the active mode M4, the non-contact tag 311 sends a signal representing completion of the shift to the receiver transmitter 30. The signal is sent, for example, by amplitude modulation in a varying magnetic field generated when the non-contact tag 311 varies the load of the antenna 3113.

In this manner, the color printer 10 receives the signal representing completion of the shift and confirms whether the ID information stored in the EEPROM 52 is identical with the ID information of the non-contact tag 311.

In the state of FIG. 8(*c*), the carriage 20 stops at the position where the receiver transmitter 30 is communicable with only the two non-contact tags 311 and 312. In this state, the non-contact tag 311 is in the active mode M4 and the non-contact tag 312 is in the standby mode M2, while the other non-contact tags 313 through 316 are in the power-off state M1. At this position, the ID information of the non-contact tag 312 is confirmed in the same manner as the confirmation of the ID information of the non-contact tag 311 discussed above. This series of processing is repeated to confirm the ID information on all the six non-contact tags 311 through 316.

After successful confirmation of the ID information on all the six non-contact tags 311 through 316, the routine goes to step S130 (FIG. 7). The color printer 10 utilizes the anti-collision function to communicate with the six non-contact tags 311 through 316 at step S130. In the case of failed confirmation of the ID information on any one of the six non-contact tags 311 through 316, on the other hand, the routine goes to step S120. No reception of the signal representing completion of the shift to the active mode M4 means failed confirmation of the ID information.

At step S120, the color printer 10 carries out an ID information acquisition process. The ID information acquisition process acquires the ID information from the six non-contact tags 311 through 316 and stores the acquired ID information into the EEPROM 52. The ID information acquisition process is triggered by output of an ID information acquisition command from the receiver transmitter 30.

In response to output of the ID information acquisition command from the receiver transmitter 30, any tag in the standby mode M2 (see FIG. 9) among the six non-contact tags 311 through 316 shifts to the ID information acquisition mode M3. For example, when the relative position of the carriage 20 to the receiver transmitter 30 is in the state of FIG. 8(*b*), only the non-contact tag 311 shifts from the standby mode M2 to the ID information acquisition mode M3.

The ID information may be acquired from the non-contact tag 311 according to the following procedure, where it is assumed that the ID information of the non-contact tag 311 is '100110':

(1) The receiver transmitter 30 of the color printer 10 checks with the non-contact tag 311 whether the $0^{th}$ bit and the $1^{st}$ bit are '00';

(2) The non-contact tag 311 does not respond to this check since the $0^{th}$ bit and the $1^{st}$ bit in its ID information are '10'. The color printer 10 thus confirms that the $0^{th}$ bit and the $1^{st}$ bit in the ID information of the non-contact tag 311 are not '00';

(3) The receiver transmitter 30 checks with the non-contact tag 311 whether the $0^{th}$ bit and the $1^{st}$ bit are '01';

(4) The non-contact tag 311 does not respond to this check since the $0^{th}$ bit and the $1^{st}$ bit in its ID information are '10'. The color printer 10 thus confirms that the $0^{th}$ bit and the $1^{st}$ bit in the ID information of the non-contact tag 311 are not '01';

(5) The receiver transmitter 30 checks with the non-contact tag 311 whether the $0^{th}$ bit and the $1^{st}$ bit are '10';

(6) The non-contact tag 311 gives a matching response since the $0^{th}$ bit and the $1^{st}$ bit in its ID information are '10'. The color printer 10 thus acquires the value '10' of the $0^{th}$ bit and the $1^{st}$ bit in the ID information of the non-contact tag 311;

(7) The receiver transmitter 30 checks with the non-contact tag 311 whether the $2^{nd}$ bit and the $3^{rd}$ bit are '00'; and (8) The color printer 10 acquires the value '01' of the $2^{nd}$ bit and the $3^{rd}$ bit in the ID information of the non-contact tag 311 in the same manner as the processing with regard to the $0^{th}$ bit and the $1^{st}$ bit.

This series of processing is repeated to acquire the value of all the bits in the ID information of the non-contact tag 311.

After acquisition of the value of all the bits in the ID information of the non-contact tag 311, the receiver transmitter 30 outputs a disable command including the acquired ID information. The non-contact tag 311 having the identified ID information then shifts to the disable mode M5.

The controller 3116 and the RF unit 3115 are at a stop in the disable mode M5, as in the power-off mode M1. The difference from the power-off mode M1 is that the disable mode M5 does not shift to the standby mode M2 regardless of the output voltage of the voltage regulator 3122. This is attained, for example, by setting the reset signal generator 3121 not to output the power-on reset command irrespective of the output voltage of the voltage regulator 3122 but to output a power-off command to the controller 3116.

The shift of the operation mode of the non-contact tag 311 having the identified ID information to the disable mode M5 assures successful acquisition of the ID information from the subsequent non-contact tag 312 at the position of the carriage 20 shown in FIG. 8(*c*).

In the following environments, the color printer 10 may fail in acquisition of the ID information from the subsequent non-contact tag 312. This is ascribed to a variation of the transmission frequency of the receiver transmitter 30 and variations of the resonance frequencies of the non-contact tags 311 and 312.

(1) The resonance frequency of the non-contact tag 311 is extremely close to the transmission frequency of the receiver transmitter 30; and (2) The resonance frequency of the non-contact tag 312 is deviated from the transmission frequency of the receiver transmitter 30 in the range of a tolerance.

Under such environments, a relatively strong electric current is flown to the antenna 3113 of the non-contact tag 311. The magnetic field produced by the antenna 3113 weakens the magnetic field in the non-contact tag 312. The non-contact tag 312 may accordingly have only an insufficient level of voltage and may not shift from the power-off mode M1 to the standby mode M2.

One possible countermeasure is to raise the transmission output of the receiver transmitter 30. This, however, leads to a potential trouble, that is, an unexpected response of the non-contact tag 313. The procedure of this embodiment shifts the operation mode of the adjoining non-contact tag 311 to the disable mode M5 after acquisition of the ID information, in order to enhance the magnetic field in the non-contact tag 312 without raising the transmission output of the receiver transmitter 30.

In the disable mode M5, substantially no electric power is consumed in the non-contact tag 311, and very little electric current is flown to the antenna 3113. This naturally leads to generation of a very weak magnetic field by the antenna 3113 and thus does not significantly weaken the magnetic field in the adjoining non-contact tag 312.

At step S130, the color printer 10 carries out a reset process. The reset process stops transmission by the receiver transmitter 30 on completion of acquisition of the ID information on all the six non-contact tags 311 through 316. The six non-contact tags 311 through 316 then shift from the disable mode M5 to the power-off mode M1, and the routine returns to step S100 (FIG. 7).

As discussed above, the procedure of this embodiment shifts the operation mode of a non-contact tag to the disable mode M5 after acquisition of the ID information on the non-contact tag and thereby prevents the magnetic field produced by the non-contact tag from being significantly enhanced. This does not significantly weaken the electromagnetic induction in an adjoining non-contact tag and thus effectively restrains deterioration of the reliability in communication.

C. Modifications

The embodiment discussed above is to be considered in all aspects as illustrative and not restrictive. There may be many modifications, changes, and alterations without departing from the scope or spirit of the main characteristics of the present invention. Some examples of possible modification are given below.

C-1. In the structure of the above embodiment, after acquisition of ID information on a cartridge from a non-contact tag attached to the cartridge, the non-contact tag is shifted to the disable mode. In the case where the color printer has already acquired the ID information of the cartridge, the non-contact tag may be shifted to the disable mode after confirmation of no change of the cartridge.

The terminology 'confirmation of ID information' in the claims is used in the broadest sense and includes acquisition of ID information discussed in the above embodiment. The 'ID information confirmation mode' in the claims is equivalent to the 'ID information acquisition mode' in the embodiment.

C-2. In the structure of the above embodiment, the non-contact tag shifts to the disable mode, in response to reception of the disable command sent from the receiver transmitter. In one modified structure, the expendable container may be designed to automatically shift to the disable mode on completion of transmission of all the ID information.

C-3. In the above embodiment, in response to a shift of a non-contact tag to the disable mode, its controller and RF unit stop the respective functions. Another possible structure may decrease the frequency of an internal clock to lower the power consumption. The only requirement for the low power consumption mode of the invention is to lessen the functions of the controller and thereby lower the power consumption. The clock signal may be oscillated and generated inside the non-contact tag.

Figure 10:
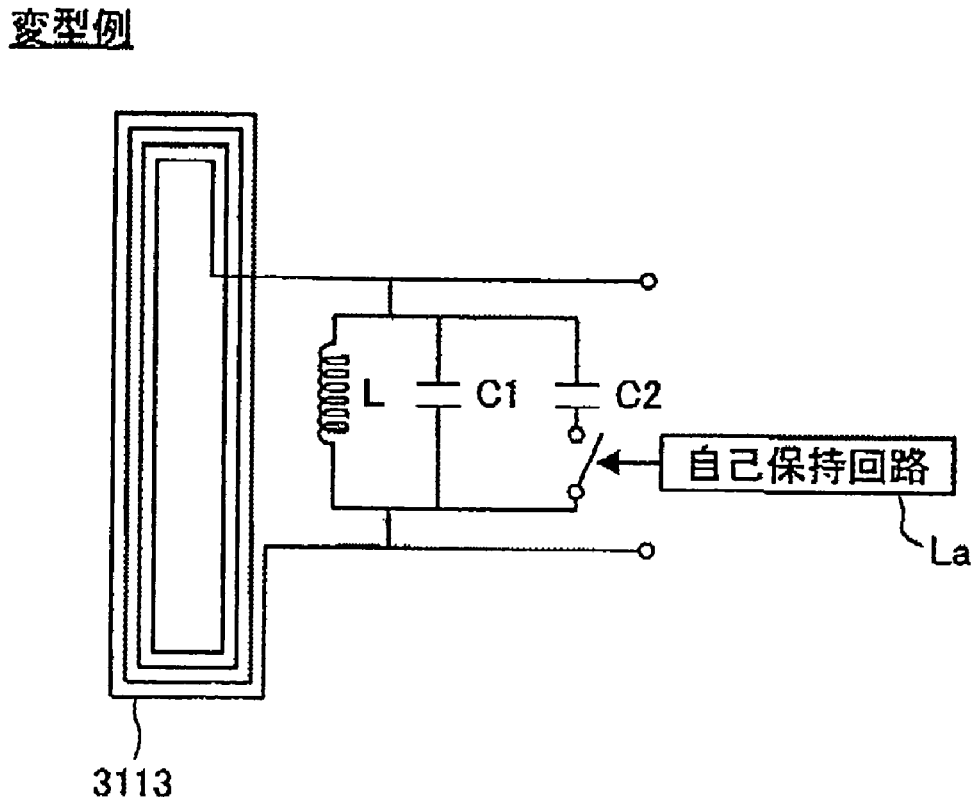
FIG. 10 shows one modified configuration in which the induced current in antenna 311 is reduced by changing the resonance frequency of the oscillation circuit.

C-4. In the structure of the above embodiment, the reset signal generator is set to output the power-off command to the controller, irrespective of the output voltage of the voltage regulator. In one modified structure, an oscillation circuit as shown in FIG. 10 may be attached to the non-contact tag. A self-holding circuit La in the oscillation circuit switches off, in response to confirmation of the ID information. This decreases the flow of electric current through the antenna 3113 and ensures an automatic reset process, in response to the weakened magnetic field by a stop of the transmission output of the receiver transmitter 30 or by the relative motion of the receiver transmitter 30. The structure of the invention is generically designed to stop the functions of the controller on completion of confirmation of ID information on the cartridge.

C-5. In the structure of the above embodiment, the color printer establishes non-contact communication with each non-contact tag by taking advantage of the electromagnetic induction. Electromagnetic coupling may alternatively be used to establish non-contact communication. The target of the invention is thus any non-contact communication without any electrical connection.

C-6. The above embodiment regards the printer with ink units detachably attached thereto. The technique of the invention is generically applicable to diverse devices with an expendable cartridge detachably attached thereto. It is not necessary that multiple expendable cartridges are simultaneously mountable on the device, but the only requirement is the device is capable of utilizing multiple expendable cartridges. In the structure of the above embodiment, the expendable cartridges are moved with the carriage (cartridge attachment module). In one modified design, the receiver transmitter may be moved, instead of the carriage.

What is claimed is:

1. An expendable container storing an expendable, the expendable container comprising:

a memory circuit having a memory, an antenna being capable of establishing non-contact communication with an external receiver transmitter, and a controller controlling the non-contact communication and an access to the memory, wherein the memory circuit having a plurality of modes including ID information confirmation mode and low power consumption mode, the ID information confirmation mode being for the receiver transmitter to communicate with the memory circuit in order to confirm ID information of the expendable container, the low power consumption mode keeping lessened functions of the controller for increasing an impedance of the controller to reduce an electrical current value of the antenna as long as the memory circuit is in operation, wherein the memory circuit is capable of shifting to the low power consumption mode in response to a completion of confirmation of the ID information of the expendable container.

2. The expendable container in accordance with claim 1, wherein the low power consumption mode is disable mode for deactivating the controller's function.

3. The expendable container in accordance with claim 2, wherein the expendable container further comprising:

a reset signal generator configured to control activation and deactivation of the controller, in response to a voltage level of a power generated by an electromagnetic induction, wherein the reset signal generator is configured to stop the controller in response to the completion of confirmation of the ID information of the expendable container.

4. The expendable container in accordance with claim 1, wherein the memory circuit is configured to receive a preset command sent from the external receiver transmitter to the expendable container in response to the completion of confirmation of the ID information of the expendable container, and shift to the low power consumption mode in response to the reception of the preset command.

5. The device in accordance with claim 1, wherein the memory circuit is configured to decrease a frequency of an internal clock of the memory circuit in the low power consumption mode, for increasing the impedance of the controller to reduce the electrical current value of the antenna.

6. A device capable of loading an expendable container that stores an expendable, the device comprising:

an expendable container loader capable of loading each of a plurality of expendable containers storing expendables at each of a plurality of predetermined locations;

a receiver transmitter capable of establishing a non-contact communication with the plurality of expendable containers; and a moving mechanism configured to move at least one of the expendable container loader and the receiver transmitter, in order to allocate the receiver transmitter at a predetermined proximity position relative to each of the plurality of expendable containers, wherein the expendable container comprises a memory circuit having a memory, an antenna being capable of establishing non-contact communication with an external receiver transmitter at the proximity position, and a controller controlling the non-contact communication and an access to the memory, wherein the memory circuit comprises a plurality of modes including ID information confirmation mode for the receiver transmitter to communicate with the memory circuit in order to confirm ID information of the expendable container, and low power consumption mode for keeping lessened functions of the controller for increasing an impedance of the controller to reduce an electrical current value of the antenna as long as the memory circuit is in operation, the memory circuit being capable of shifting to the low power consumption mode in response to a completion of confirmation of the ID information of the expendable container, wherein the device is configured to confirm the ID information of the plurality of expendable containers corresponding to the predetermined plurality of locations, at which the plurality of expendable containers are loaded, based on relative positions of the plurality of expendable containers to the receiver transmitter and the confirmed ID information of the multiple expendable containers.

7. The device in accordance with claim 6, wherein the receiver transmitter is capable of sending a command to the expendable container to shift the memory circuit to the low power consumption mode, in response to the completion of confirmation of ID information of the expendable container.

* * * * *